US006540089B2

(12) United States Patent
Brock et al.

(10) Patent No.: US 6,540,089 B2
(45) Date of Patent: Apr. 1, 2003

(54) LARGE, STATIONARY, MODULAR AGGREGATE PROCESSING PLANT AND METHOD OF MANUFACTURING AND INSTALLING SAME

(75) Inventors: J. Don Brock, Chattanooga, TN (US); William R. Gray, New Berlin, WI (US)

(73) Assignee: Astec Industries Inc., Chattanooga, TN (US)

( * ) Notice: Subject to any disclaimer, the term of this patent is extended or adjusted under 35 U.S.C. 154(b) by 109 days.

(21) Appl. No.: 09/836,394

(22) Filed: Apr. 17, 2001

(65) Prior Publication Data

US 2002/0148760 A1 Oct. 17, 2002

(51) Int. Cl.[7] ..... B07B 1/28

(52) U.S. Cl. ..... 209/316; 209/234; 209/352; 209/353; 209/354; 209/931; 52/79.1; 52/79.7; 52/79.9; 52/745.1; 52/745.2

(58) Field of Search ..... 209/316, 352, 209/353, 354, 355, 931; 52/79.1, 79.7, 79.9, 745.03, 745.1, 745.13, 745.2

(56) References Cited

U.S. PATENT DOCUMENTS 2,150,717 A 3/1939 Jaxon
3,909,401 A 9/1975 Thompson
5,433,575 A 7/1995 Milstead
5,634,716 A 6/1997 Westall et al.

OTHER PUBLICATIONS

Bahama Rock: Something New Under the Sun, Aggregate & Mining Journal, vol. 1, No. 3, pp. 2–5.*

* cited by examiner

*Primary Examiner*—Donald P. Walsh
*Assistant Examiner*—Jonathan R Miller
(74) *Attorney, Agent, or Firm*—Patterson, Thuente, Skaar & Christensen, LLC

(57) ABSTRACT

A method of manufacturing a large stationary, aggregate processing screening tower by fabricating weldment modules and preassembling them with aggregate processing equipment internal within the weldment modules, transporting the preassembled weldment modules to a field work site where the tower is to be erected on a foundation, aligning the modules and stacking the modules in layers and then bolting adjacent modules together. A large stationary, aggregate processing screening tower has weldment modules preassembled with aggregate processing equipment internal within the modules. The preassembled modules are stacked up on one another and secured together and can receive aggregate product at the top module and the product is processed by screening and sizing as it moves downwardly by gravity through the modules and their processing equipment for final clarification and collection of the product.

15 Claims, 13 Drawing Sheets

LARGE, STATIONARY, MODULAR AGGREGATE PROCESSING PLANT AND METHOD OF MANUFACTURING AND INSTALLING SAME

BACKGROUND OF THE INVENTION

1. Field of the Invention

A particularly large, stationary, modular, open framework type of static structure for supporting apparatuses to perform desired operations, such as sorting and classifying mine rock for use as aggregate or other material.

2. Discussion of the Related Art

U.S. Pat. No. 5,634,716, issued Jun. 3, 1997 to Westall et al., discloses a portable PVC resin blending system mounted in a steel silo having multiple level therein. This patent discloses a portable batch blending system which, by reducing the cross-sectional size of the blending system to a limited diameter cylinder, can be transported across roads, for example, from the plant where it is manufactured to the field where it is put in use. The unit can then be readily relocated without disassembling the system.

U.S. Pat. No. 5,433,575, issued Jul. 18, 1995 to Milstead, is assigned to assignee common with the present invention. This patent shows a method of erecting a relatively small, portable asphalt production plant. Upper and lower subassemblies of the plant are transported to a worksite on a portable frame towed by a tractor. A portable plant of this type can be transported from one worksite to another by a vehicle.

U.S. Pat. No. 2,150,717, issued Mar. 14, 1939 to Jaxon, discloses an apparatus for screening and loading coal.

U.S. Pat. No. 3,909,401, issued Sep. 30, 1975 to Thompson, shows a relatively small portable screening tower mounted on a wheel vehicle having a first framework connected to the ground engaging means, and a second framework movably vertically with respect to the first framework and having a material screening facility mounted thereon.

OBJECTS AND SUMMARY OF THE INVENTION

The present invention provides a particularly large and stationary modular aggregate processing tower structure and method of manufacturing, assembling and installing the structure. The structure of the present invention may be 100 feet in height and 40 to 60 feet in length. The invention contemplates producing such a tower in a number of layers of weldment modules, for example, five layers of modules, the modules each being substantially completely assembled in the plant. That is to say, to the extent possible, assembling the various components within the individual modules is done at the plant. The various components to be inserted in the modules may consist of, for example, aggregate classifiers, screens, collecting chutes, blending units, stairways and walkways. In this manner, the majority of the manufacturing and assembly can be done in the plant and thus avoid the necessity of such manufacturing and assembly to be done at the field erection site.

The preassembled modules are then transported to a field site where they are then aligned with one another by interengaging parts and then secured together as by bolting them into a permanent rigid plant. In one form of the invention the stacked modules receive aggregate product at its uppermost module by means of a conveyor elevator, and the aggregate is processed by screening, blending and sizing into aggregate product as it moves downwardly by gravity through the modules and their processing equipment. The final collection of product is made at various levels.

The above method includes providing a multiple deck screen in the uppermost module and which screen is inclined downwardly for passing aggregate product over the screen and into collecting chutes beneath this multiple deck screen. The product is then discharged out of the chutes as four different size products.

Still a more limited aspect of the invention relates to a method of the above type in which a screening tower is provided having five layers of weldment modules, the modules being fabricated in the factory and preassembled with certain aggregate processing equipment, chutes and gates internal within the module. The five layers of preassembled modules are then transported by huge tractor-trailers, for example, and/or by rail or ships to the field quarry or the like where they are aligned with one another by means of interengaging parts and then rigidly secured together. In one form, the fifth, top module receives the aggregate product from a conveyor or the like and the product then moves downwardly by gravity through the stacked modules and is screened, blended and sized as it moves through appropriate screens, chutes, blenders and gates within the modules. The product is collected in various classifications at the various levels.

A further aspect of the invention relates to a method of the above type in which the lower layers of modules are assembled in stacked relationship and then a large double screen vibrator is inserted downwardly into the lower layers of modules, for example, the second and third layers, and then the vibrator is secured therein. Then the upper layers of modules, for example, the fourth and fifth layers of modules, are assembled thereon and rigidly secured in place.

The invention also provides a large stationary modular aggregate processing screening tower having weldment modules preassembled, having aggregate processing equipment internally within the modules. The preassembled modules are guided into alignment and are then secured together. The stacked modules are adapted to receive aggregate product at the top module and the product is screened and sized as it moves downwardly by gravity through the lower modules.

The invention provides a large stationary modular aggregate processing screening tower having five layers of weldment modules with aggregate processing equipment and accessories internal within them. The layers of modules have interengaging guiding means for aligning them vertically with respect to one another and are then bolted together. The arrangement is such that the layers of modules receive aggregate product at the top fifth layer module and the product is processed by screening, sizing, blending and/or classifying as it moves by gravity downwardly through the layers of weldment modules. The product is collected at various levels in their proper classifications.

Still another object of the present invention relates to providing a modular screening tower having a double screen vibrator having its two screens positioned one above the other and the lower discharge end of the screens have separate outlet conduits for discharging the screened product. A hot air conduit is in communication with the vibrator adjacent the discharge end of the lower of said screens. This conduit directs hot air into the lower end of the vibrator where the air rises within the vibrator to dry the sand product therein. An oil or gas heater is in communication with the heat conduit for supplying hot air to the vibrator.

The invention furthermore provides the vibrator of the above type in which a reversible screw conveyor is located below the two outlet conduits of the vibrator for receiving product and conveying the product selectively to two separate receptacles.

The invention furthermore provides a primary aggregate handling plant having several modules arranged in vertical alignment and others being laterally offset in working relationship with others to provide continuous processing of aggregate through all of them.

Another object of the present invention is to provide a double screen vibrator and air heater for drying the sand and thereby making concrete sand without the use of water to wash the fine 200-mesh dust off of the coarser material. Hot air pulled through the lower screen deck dries the material sufficiently to suck off the minus 200-mesh material to thereby produce clean, dry product without the use of water.

Another object of the present invention is to provide a double screen vibrator having two stationary vertical side walls with upper and lower screens positioned one above the other and mounted between the side walls and positioned at a downwardly inclined angle. The vibrator has a lower discharge end with outlet conduits for discharging screened product from the screens. High frequency electric vibrators are connected with the screens for vibrating the screens at a frequency of 3000 to 5000 rpm. A hot air heat conduit is in communication with the vibrator adjacent the discharge end of the lower of the screens and for directing hot air into the vibrator where the air rises within the vibrator to dry the product such as sand therein. A heater is in communication with the heat conduit for supplying hot air to the conduit and over the sand to reduce the moisture content of the fine sand to 2% to 3% and remove the fine 200-mesh particles of sand to achieve production of concrete sand in a dry application.

These and other objects and advantages of the present invention will appear hereinafter as this disclosure progresses.

DESCRIPTION OF THE PREFERRED EMBODIMENTS

Figure 6:
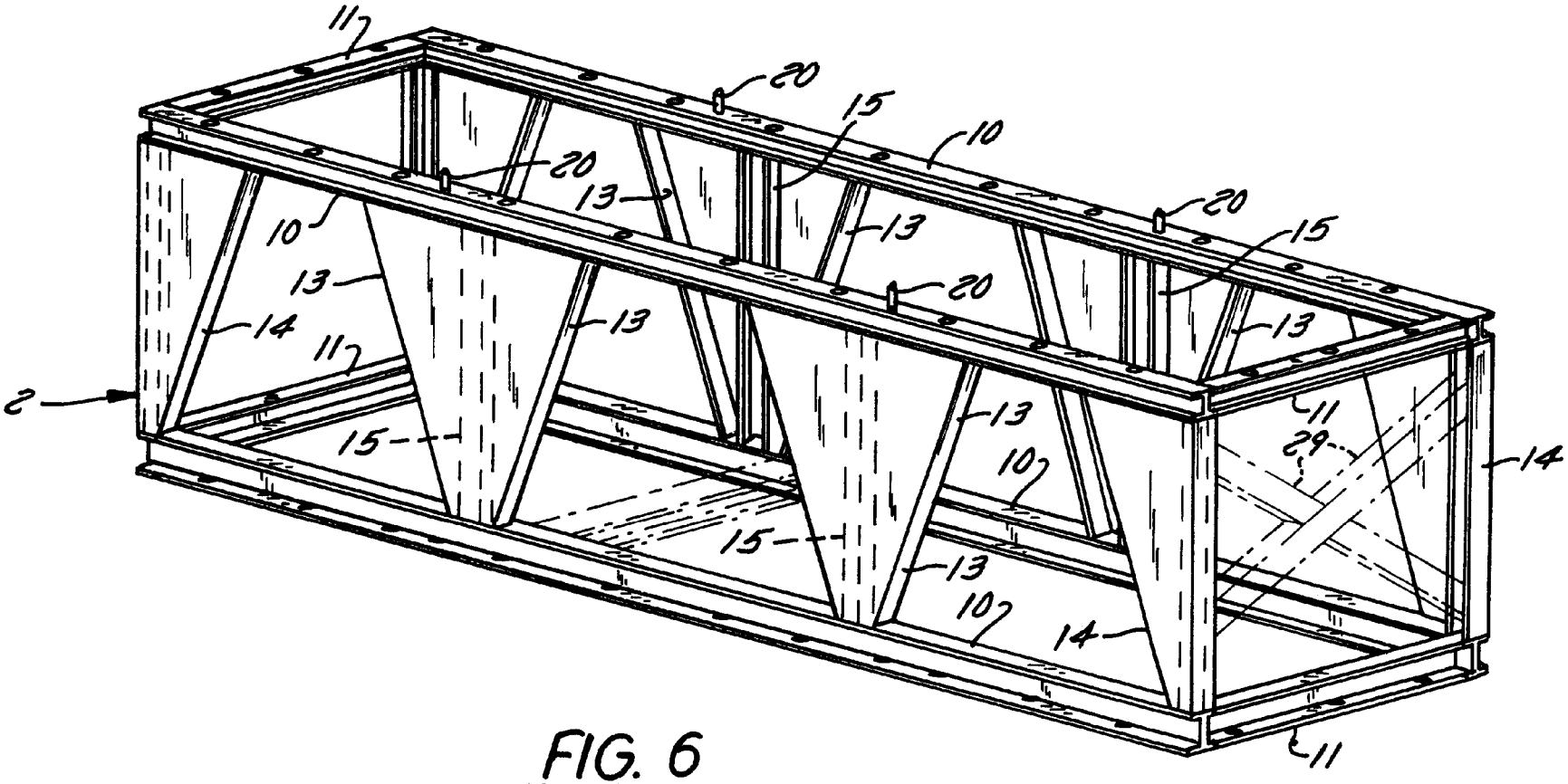
FIG. 6 is a perspective view of the second weldment module as shown in FIGS. 1, 4 and 5.

The weldment modules provided by the present invention are formed by structural steel I-beams, channels or the like and which are welded together as shown in FIG. 6. The elongated horizontal steel channels 10 have cross channel members 11 welded thereto. The legs between the upper channel members and the lower channel members are formed of steel plates and fabricated to have reinforcing edges 13, and some of them have a central steel post 15, all welded together. This forms a particularly rigid and heavy structure.

The various weldment modules are designated by the lowermost module 1, the second module 2, the third module 3, the fourth module 4, and the fifth or top module 5. The five modules are vertically aligned with one another by means of the large pins 20 (FIGS. 4, 6, 9 and 10) which are welded in one of the modules and extend upwardly therefrom to receive the adjacent upper steel channel member 10, for example. There are four such pins located between each adjacent pair of modules. The adjacent weldment modules are secured together firmly by the bolt means 22 and nuts 23 which extend through aligned holes between adjacent weldment modules. There are ten such bolts along each longitudinal side of the modules.

Figure 1:
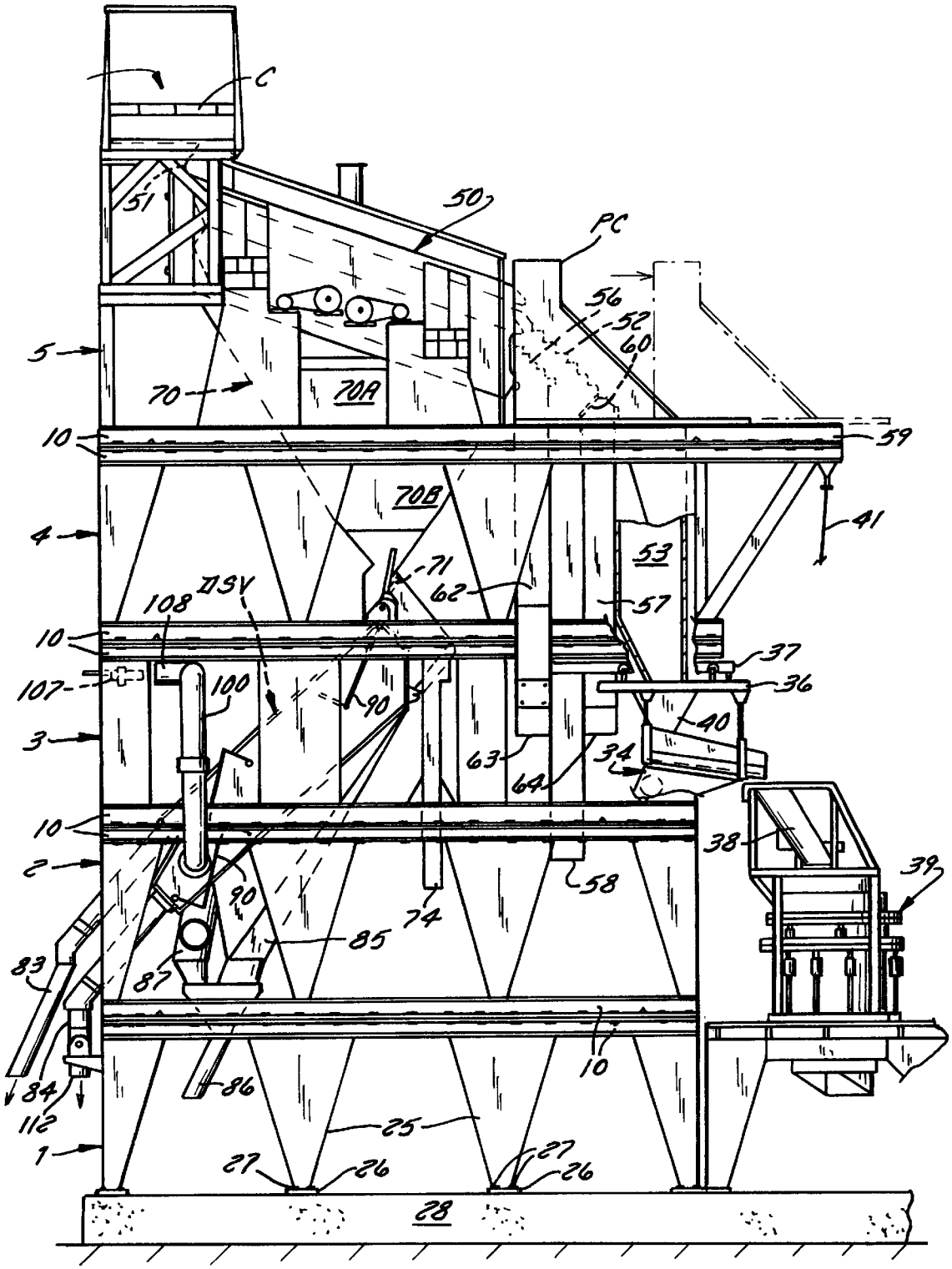
FIG. 1 is a front elevational view of a screening tower made in accordance with the present invention and showing the five layers of modules stacked one upon another, some of the parts having been removed for the sake of clarity in the drawings.
Figure 11:
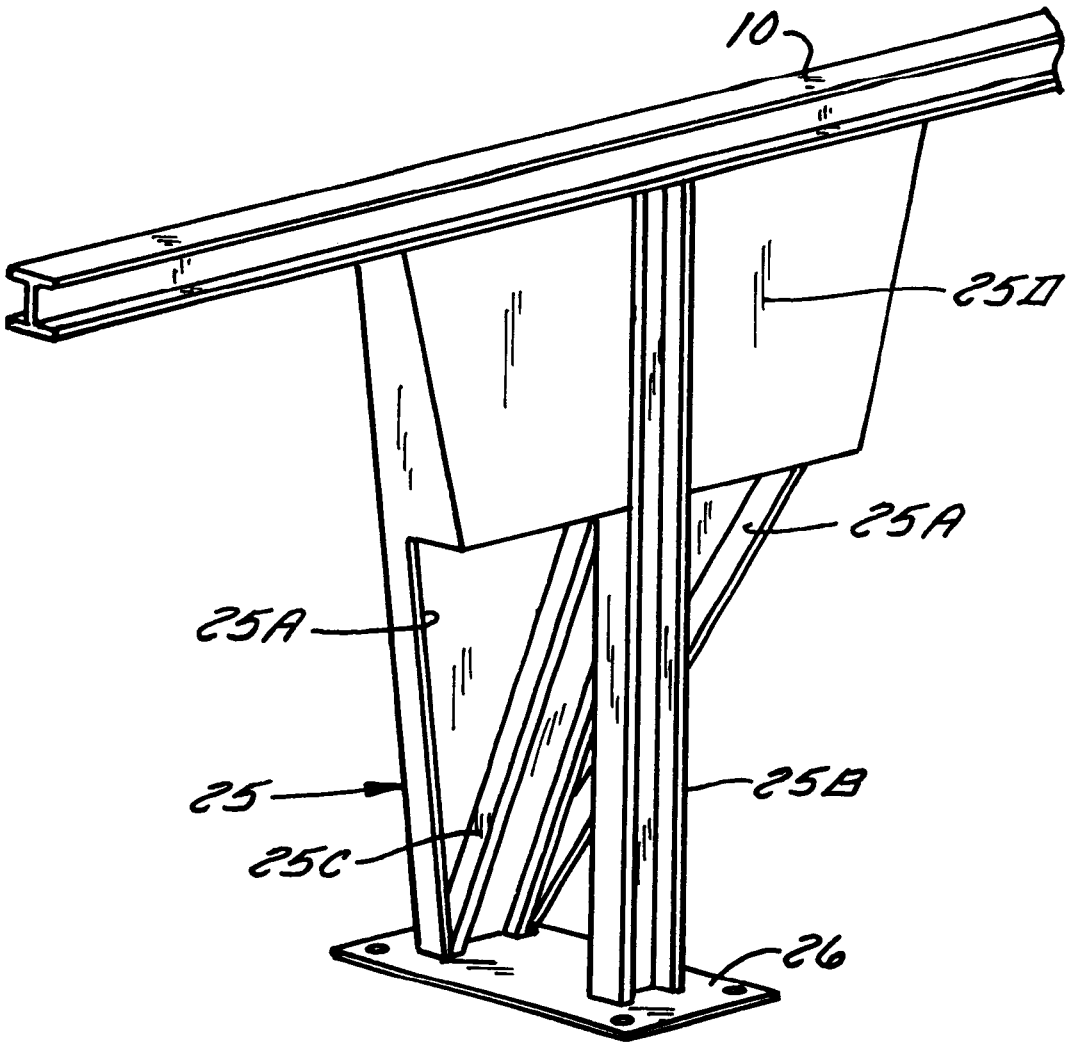
FIG. 11 is a fragmentary, perspective view of the vertical support columns for the first weldment layer or module and as shown in FIGS. 1–5.

Referring further to the structure of the lowermost module 1, FIG. 11 is a perspective fragmentary view of one of the legs 25 as shown in FIGS. 1–5. It will be noted that these legs 25 are formed from an outer steel sheet generally triangular in shape when viewed in elevation (FIGS. 1 and 5) and having inwardly turned edges 25A along their vertical sides as shown in FIG. 11. The legs 25 also include central support I-beams 25B and 25C. Furthermore, the legs 25 include a reinforcing and strengthening steel box-like weldment 25D. The bottom legs have a steel plate 26 welded at the lower end of the leg members and this steel plate 26 is secured by bolt means 27 that are embedded in the concrete foundation 28 (FIG. 1).

The above-described legs are and must be particularly strong to carry the weight of the tower of the present invention.

The vertical legs or spacers between the other weldment layers of the tower do not all do not have nor do they need the box-like fabricated weldment 25D shown in FIG. 11. Instead, these legs between the upper weldment modules are formed of heavy plate steel generally of triangular form, as shown, and may have reinforcing central I-beams 15 (FIG. 6) welded thereto.

Figure 3:
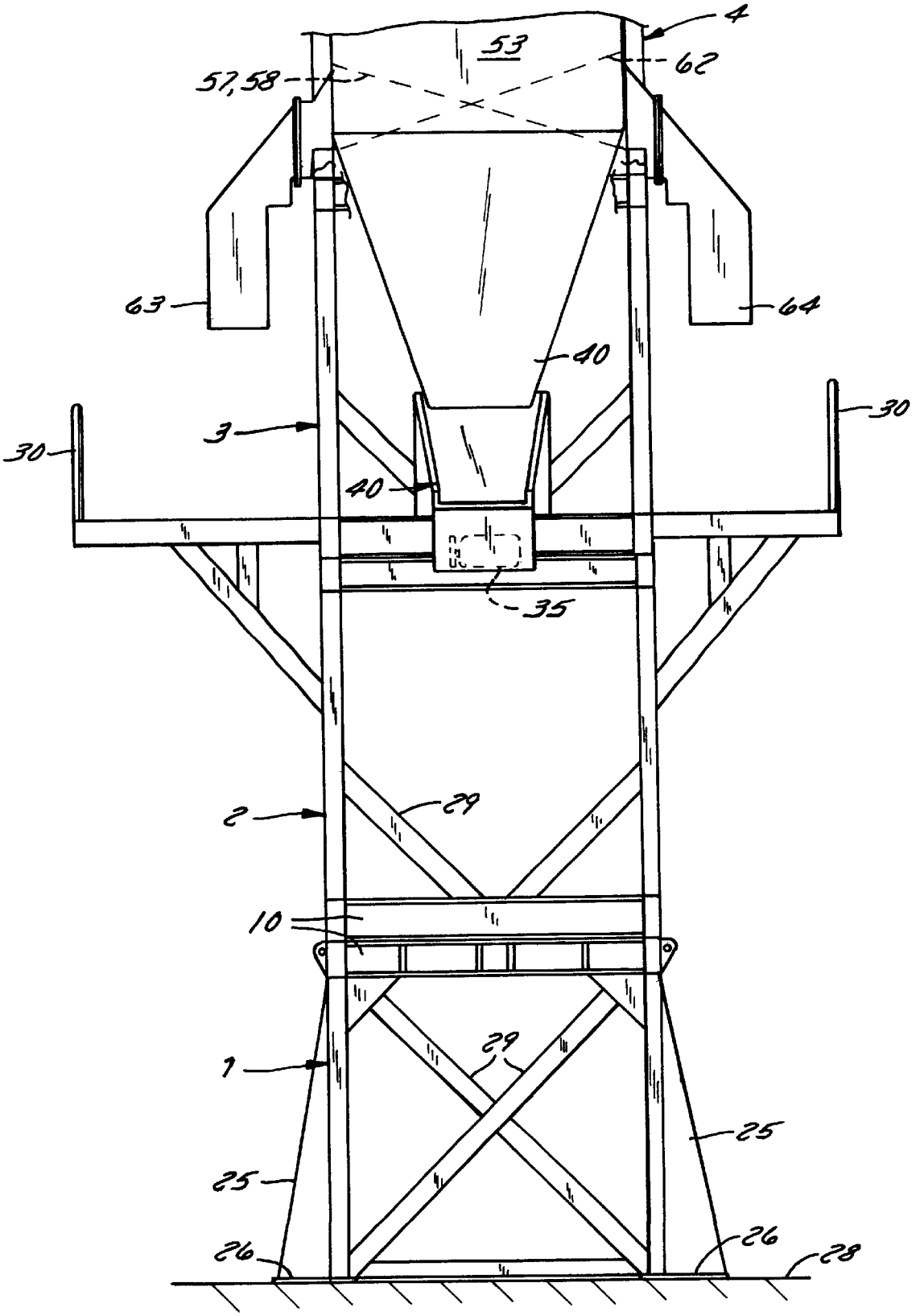
FIG. 3 is a right side view of the arrangement shown in FIG. 1, the view being fragmentary and enlarged from FIG. 1, and showing certain parts removed for the sake of clarity.

As shown in FIGS. 3 and 6, for example, cross braces 29 are welded between the sides of the weldment modules.

Figure 4:
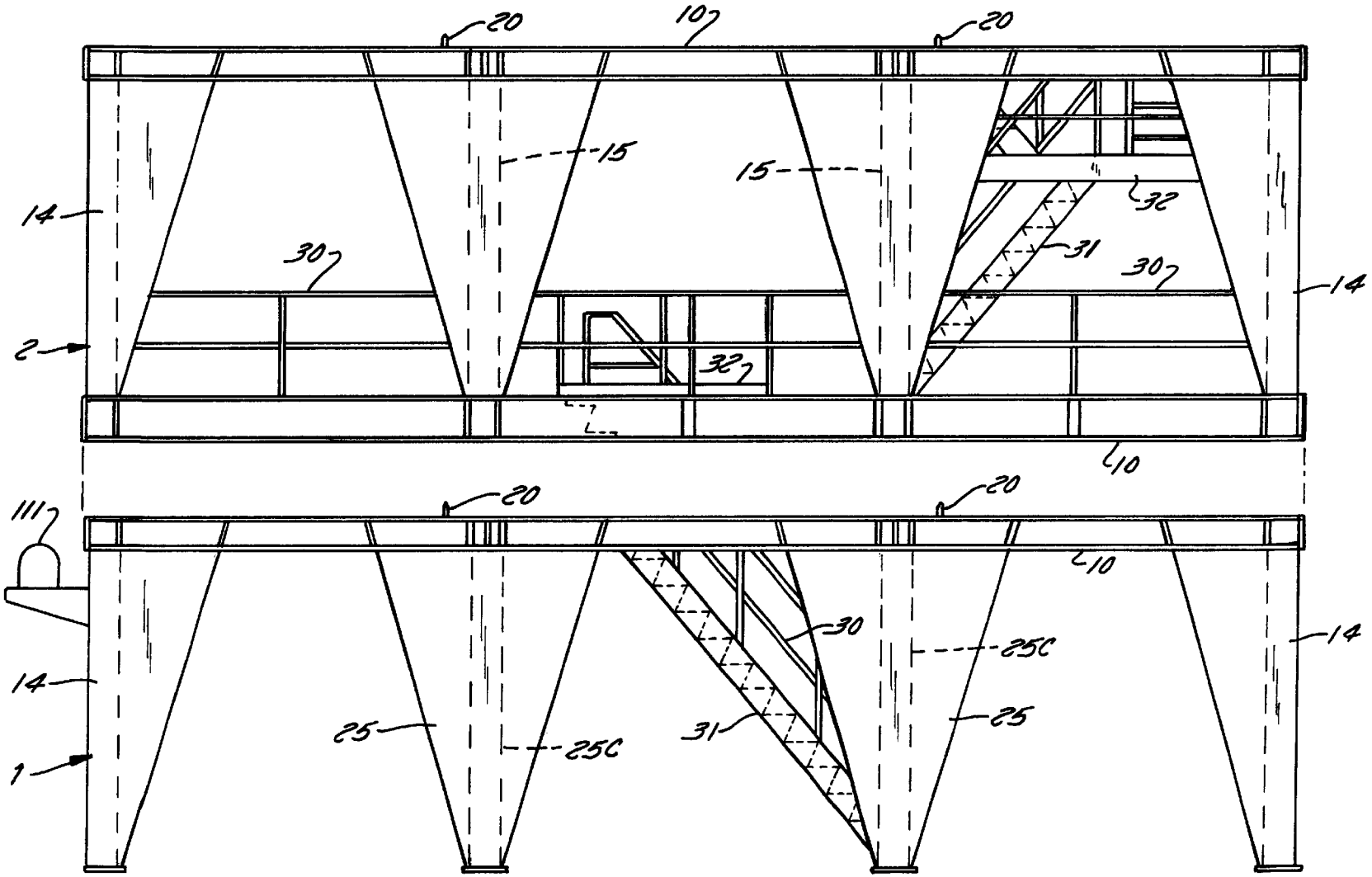
FIG. 4 is a front elevational view of a portion of FIG. 1 and showing the first two layers or modules and enlarged from FIG. 1 with certain parts removed for the sake of clarity in the drawings, the view showing the first and second layers in exploded relationship with one another.

It will be understood that, as shown in FIG. 4, certain hand rails 30 and stairways 31 and walkways 32 are provided in the modules for workmen who must continually climb the tower of the present invention, in order to maintain and adjust the various aggregate handling equipment in the modules as will appear.

Figure 7:
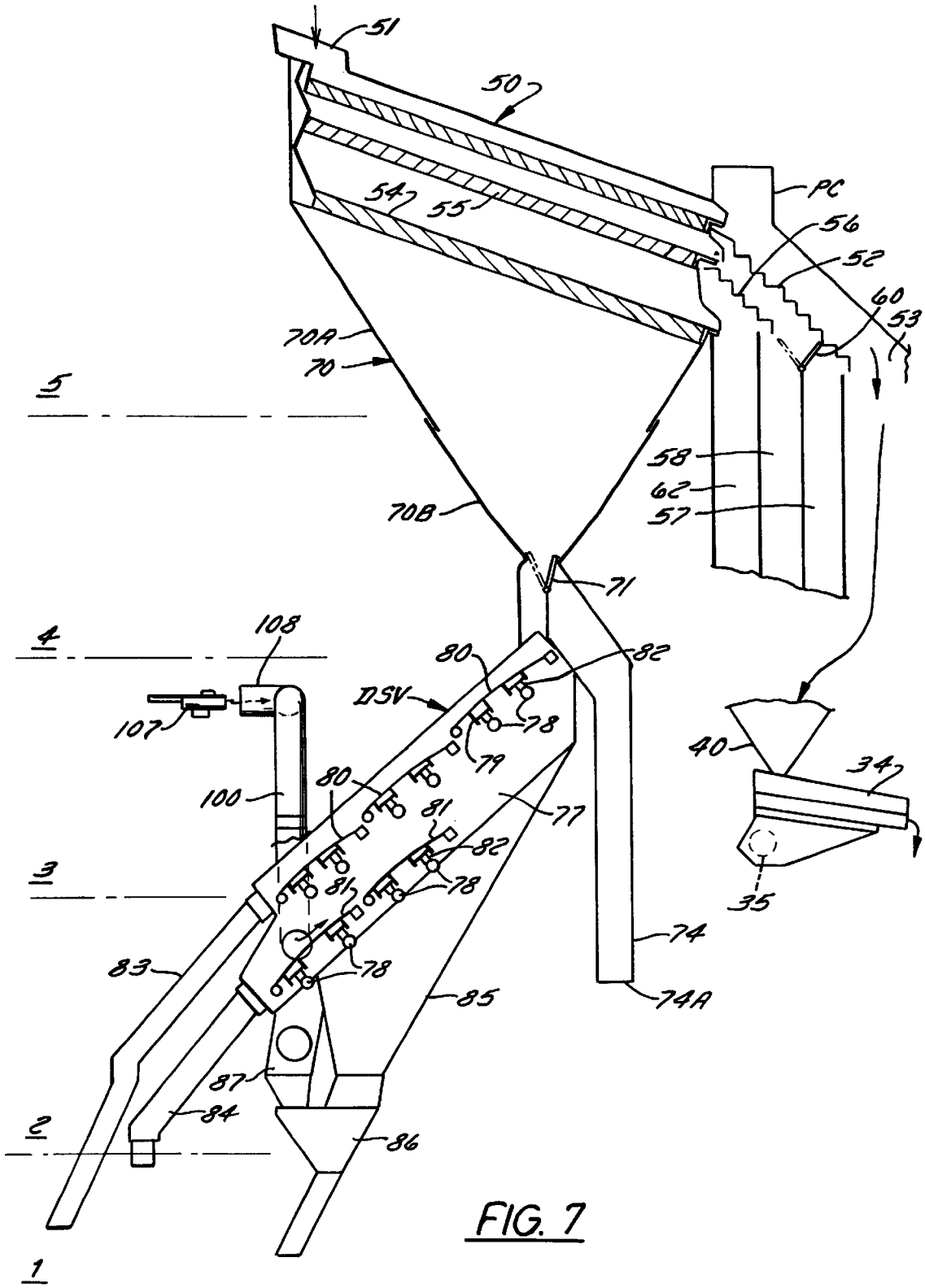
FIG. 7 is a schematic and enlarged view of portions of FIG. 1 and showing the triple deck screen in the top weldment module, the surge bin and vibrating feeder therefor, and the two-screen vibrator that is located in the second and third modules.

The general operation of the screening tower is that aggregate from an adjacent mine, for example, is delivered from the ground to the top of the tower by means of an elongated conveyor C, only partially shown (FIG. 1). This endless conveyor delivers the raw aggregate to the uppermost side of the large triple deck screen 50 located at the upper side of the top fifth weldment layer 5. The raw aggregate enters the trough 51 (FIGS. 1 and 7) of the triple deck screen and works its way downwardly by gravity over the screen cloths 52 and 56 where it is discharged at the lower right end as shown in FIG. 7.

The product chute PC (FIGS. 1 and 7) is mounted on the beam 59 and can be rolled out to the broken line portions shown in FIG. 1 to provide access to the screen cloths 52 and 56.

The discharge from the top screen is the coarsest and drops by gravity over screen cloth 52 where it ultimately falls into the large surge bin 53 for delivery to the vibrating feeder 34.

The feeder 34 and its vibrator 35 are mounted on a trolley 36 that rides on the track 37 so that it can be positioned to discharge the product off to the chute 38 for ultimate deposit in a conventional gyratory crusher 39 or the like at the side of the tower. The trolley 36 and the lower section, tapered hopper 40, of the surge bin 53 can be rolled back to provide clearance for the removal of the parts (not shown) of the gyratory crusher by a hoist cable 41.

The discharge from the upper part of the second screen 55 (FIG. 7) falls over the screen cloth 56 and can be directed either to the chute 57 or 58 depending on the position of the flip-flop, i.e., diverter valve 60. The discharge from the lowermost portion of the triple deck screen 50 drops by gravity into a chute 62 that in turn discharges out of the discharge spout 63 (FIG. 3). The discharge from chutes 57, 58 is diverted to the discharge chute 64 (FIG. 3) where it is collected in receptacles (not shown).

The discharge through the lowermost screen 54 falls into the large hopper 70 which tapers downwardly to the discharge end of the chute where a flip-flop or diverter valve 71 is located. The hopper 70 is comprised of an upper portion 70A located and fixed in the top weldment module 5. The lower portion 70B of the hopper 70 is located in, fixed in the weldment module 4, and receives the discharge from the upper portion 70A of the hopper. These hopper portions 70A and 70B are fabricated at the factory and secured within their respective weldment modules.

Figure 8:
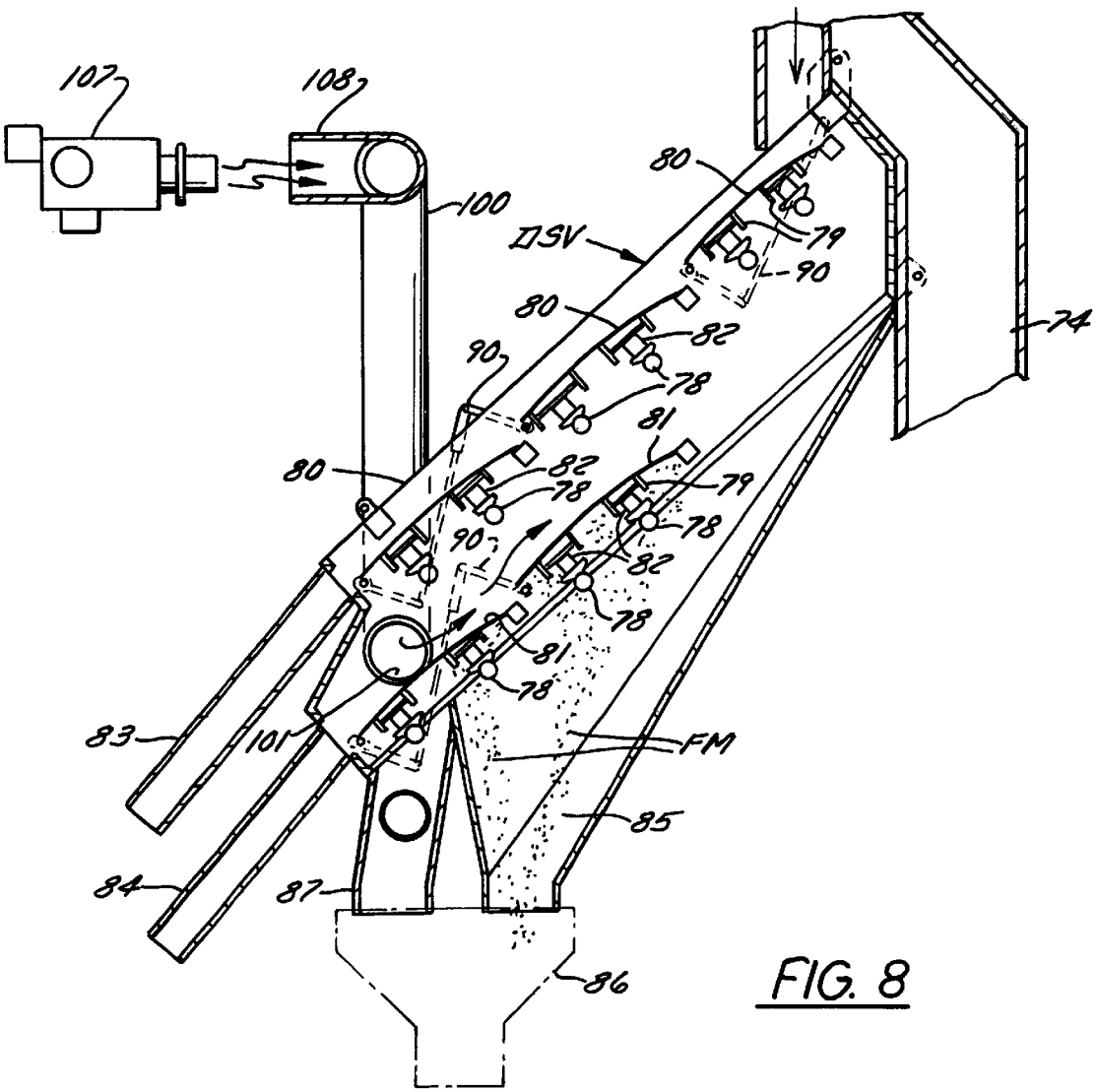
FIG. 8 is an elevational view of the two-screen vibrator shown in FIG. 7, but on an enlarged scale, certain parts being shown as removed or in section for the sake of clarity.

The flip-flop valve 71 in one position diverts the discharge from the large hopper 70 to the chute 74 (FIGS. 1, 7 and 8). The discharge from chute 74 is directed to a suitable container, not shown, at the discharge end 74A of the chute (FIG. 7).

In another position (FIGS. 7 and 8), flip-flop valve 71 can divert the material from the large hopper 70 to the upper end of the double screen vibrator DSV which is shown in FIGS. 1, 2, 5, 7 and 8.

Figure 5:
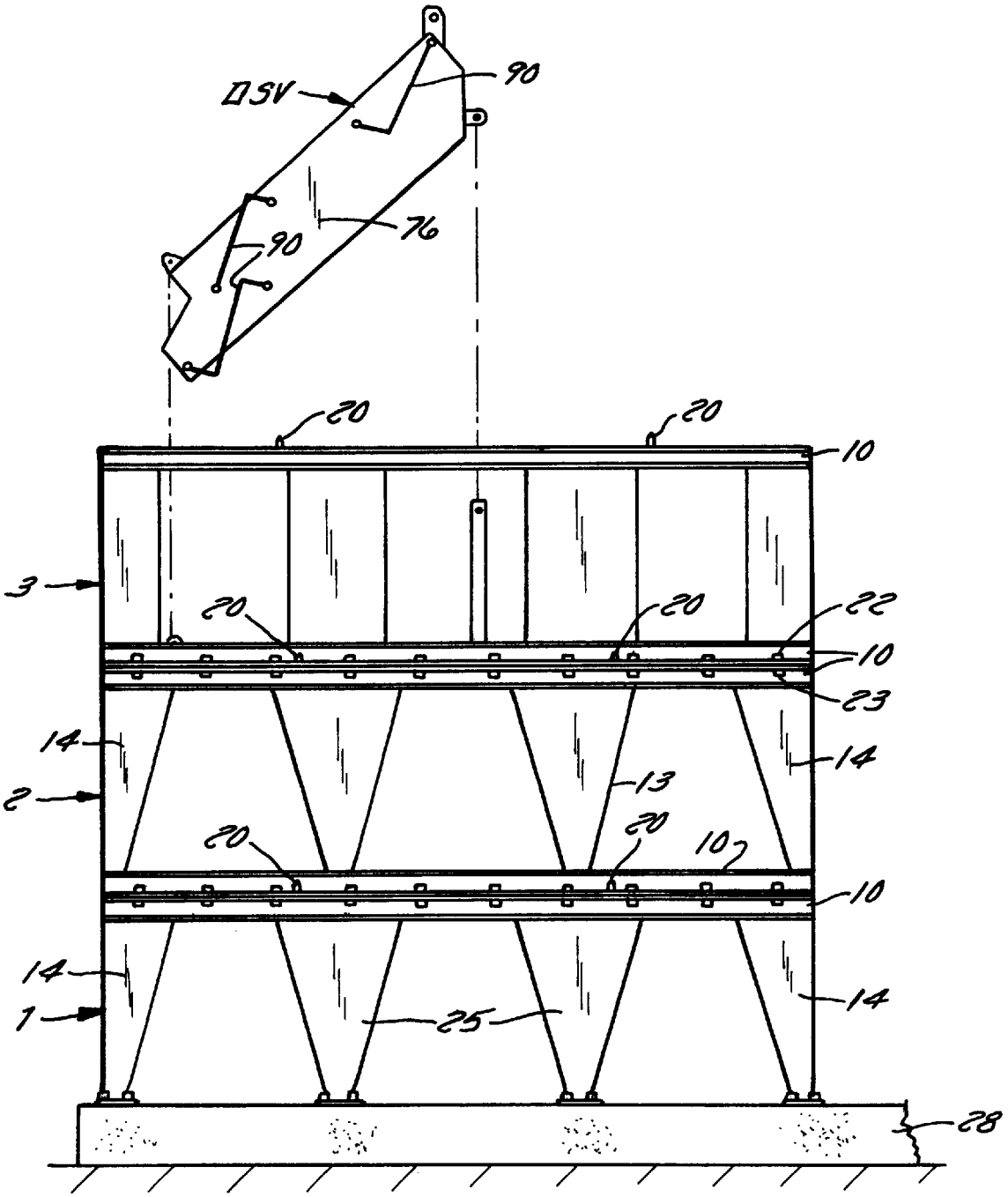
FIG. 5 is a front elevational, fragmentary view of the first three layers of modules as shown in FIG. 1, certain parts being removed for the sake of clarity and showing the two-screen vibrator above the third layer and for positioning downwardly into the second and third layers as shown in assembled relationship in FIG. 1.

As shown in FIG. 5, the double screen vibrator DSV is assembled in the tower under construction when the first three weldment modules 1, 2 and 3 have been assembled. The double screen vibrator is particularly large and cannot be installed at the plant as are the other components previously described. Instead, it is lowered by a crane (not shown) into the modules 2 and 3 as shown in FIG. 5.

The double screen vibrator DSV has a pair of stationary vertical side walls 76, 77 (FIG. 2) with a series of upper screens 80 and lower screens 81 (FIGS. 7, 8, 8A) vibrated by high frequency electric motors 78 which are mounted to cross bars 82 and to which are secured the activating tappets 79 and over which the screens lay. The screens are woven wire panels and are tensioned by the crank and rods 90 (FIGS. 5 and 8). The high frequency vibrators 78, which are electric motors with variable speed drives, are used to vibrate the screen through the tappets 79 at frequencies of 3000–5000 rpm. This produces a very fine separation of material in the 8 to 30 mesh range. Hot air is injected through the stationary side walls 76, 77 of the vibrator housing (as will appear) so it can be ducted through the bottom vibrating deck to remove the minus 200 fraction of material from the 30 to 16 mesh rock.

Figure 8A:
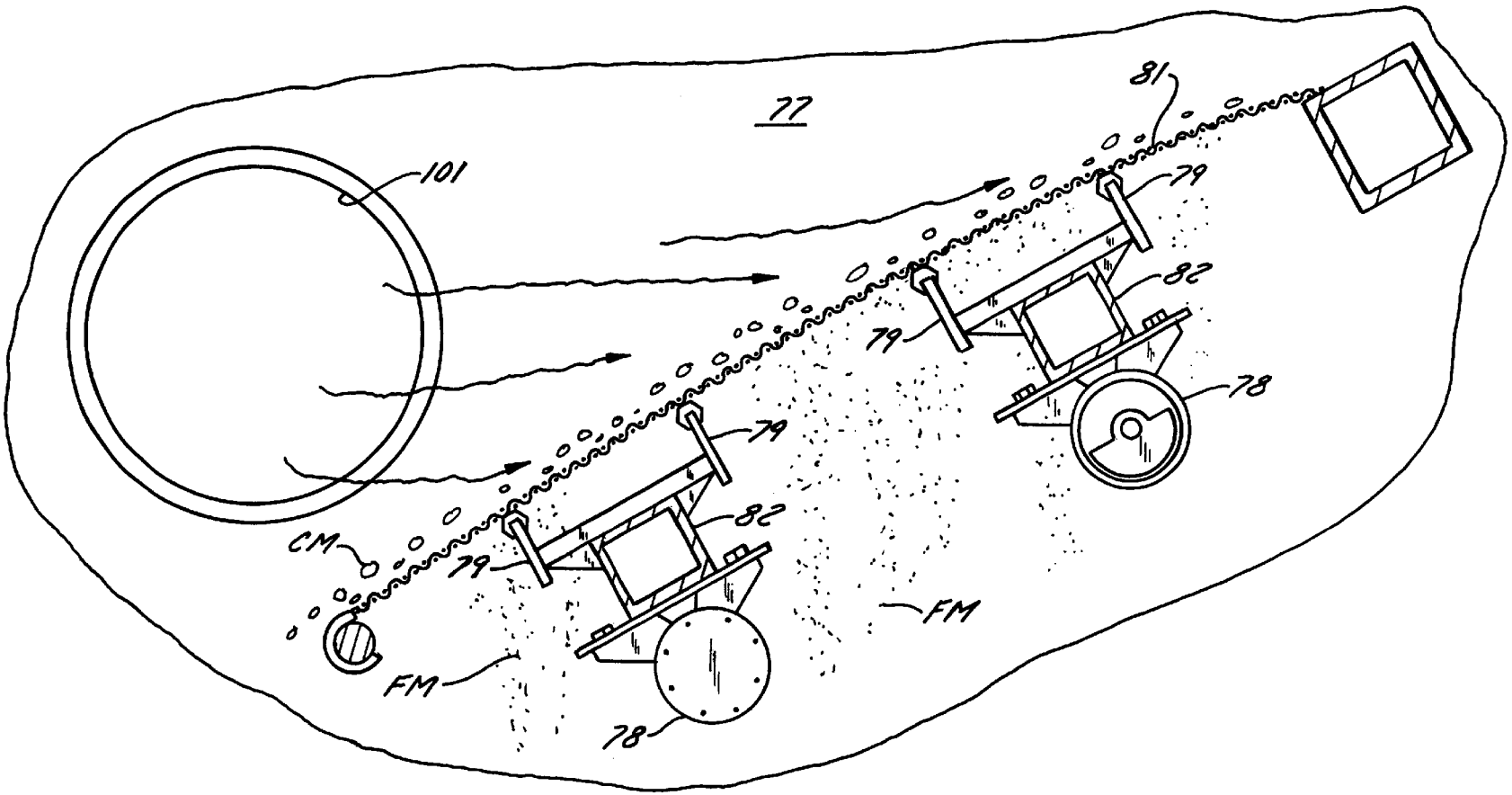
FIG. 8A is a fragmentary view of a portion of FIG. 8, in an enlarged scale.
Figure 9:
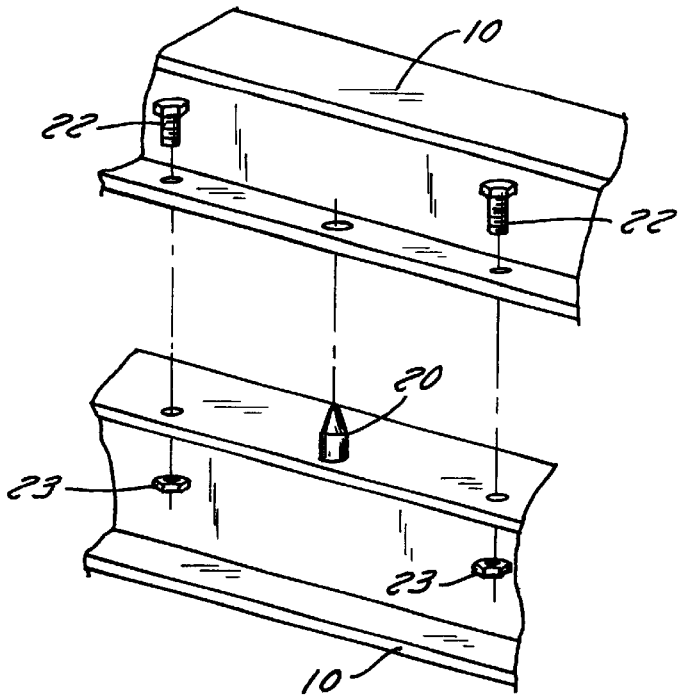
FIG. 9 is a fragmentary, enlarged view of adjacent members of the weldment modules and showing the locating pin for aligning the modules and the bolts for rigidly securing the modules together.
Figure 10:
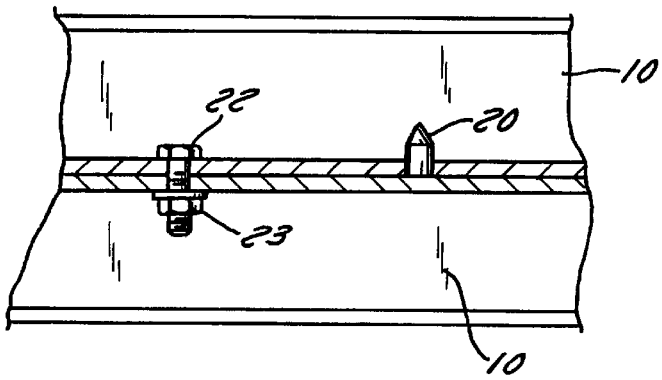
FIG. 10 is a view of the arrangement shown in FIG. 9 but in assembled relationship.

In the double screen vibrator of the type described here, the fine material, such sand, that is ultimately located above the lower screens 81 may be of a moisture content that prohibits from further movement across the screen. For example, this sand, which may have a moisture content of 10% to 14%, covers the screen deck. It is necessary to reduce this moisture content, for example, to 2% to 3% to permit proper operation of the double screen vibrator. For this purpose, as shown in FIGS. 1, 2, 7 & 8, the present invention provides a unique heat source for providing hot air to the lower portion of the double screen vibrator and more particularly to the lower screen 81 of the double screen vibrator. This heating means takes the form of a large circular conduit 100, which is located in the stationary side walls 76, 77 of the double screen vibrator DSV in weldment modules 2 and 3. It should be noted that this donut shaped (FIG. 2) or circular conduit 100 is installed in place after the vibrator DSV and modules 2 and 3 have been assembled in the field. Heat is supplied to the upper portion of the hot air heat conduit 100 by means of oil or gas heater 107 that blows hot air into the upper entry portion 108 of the hot air conduit 100. This hot air then passes downwardly in both sides of the conduit 100 and into the lower end of the double screen vibrator as at 101 (FIGS. 8 and 8A). As indicated by the curvilinear arrows in FIGS. 8 and 8A, the hot air comes out of the lower portion of the hot air conduit 100 and passes upwardly over the sand located on the vibrating screens 81 and upwardly into the upper end of the vibrator, thus heating the inside thereof. This hot air acts to reduce the moisture content of sand and fine-sized aggregate, for example, to 2% to 3%, and remove the fine mesh particles (FM), i.e., 200-mesh through the screen 81. This allows production of concrete sand in a dry application, while achieving the sand specification by removing the 200-mesh material.

The hot air heater 107 may be of the type manufactured by Power Flame Incorporated of Parson, Kans. and more specifically the Model C-1. The output of this particular burner is in the neighborhood of the maximum of 1.3 million BTUs per hour but need not deliver such heat continuously. Instead, for example, it may run at one-third of its maximum most of the time.

Material from the double screen vibrator is discharged in one of three areas, that is, via conduit 83 from the top screens 80 or via chute 84 from the lower screens 81, or the extremely fine material FM or dust is collected from beneath screens 81 in the large hopper 85 (FIGS. 7 and 8) located beneath the double screen vibrator. The fine material FM from the large collecting chute 85 is gathered in the hopper 86. This fine dust-like material FM is also collected via conduit 87 that also discharges into the hopper 86. This fine material is ultimately delivered to the bag house (not shown) or the base area (not shown) of the asphalt being laid.

In many areas of the country there is a shortage of water, which-prevents the production of sufficient quantities of concrete sand. This invention allows the product to be produced dry as follows. The present invention permits the removal of the minus 200-mesh material FM from the coarser material CM (FIG. 8A), thus permitting making concrete sand without using water to wash the fine 200-mesh dust FM off the coarser material. Concrete sand generally is in the quarter mesh down through 30 mesh and cannot have over 0–3% minus 200-mesh material. The hot air being pulled through and over the bottom deck dries the material sufficiently to suck off the minus 200 material FM and produces clean, dry product without water.

Figure 2:
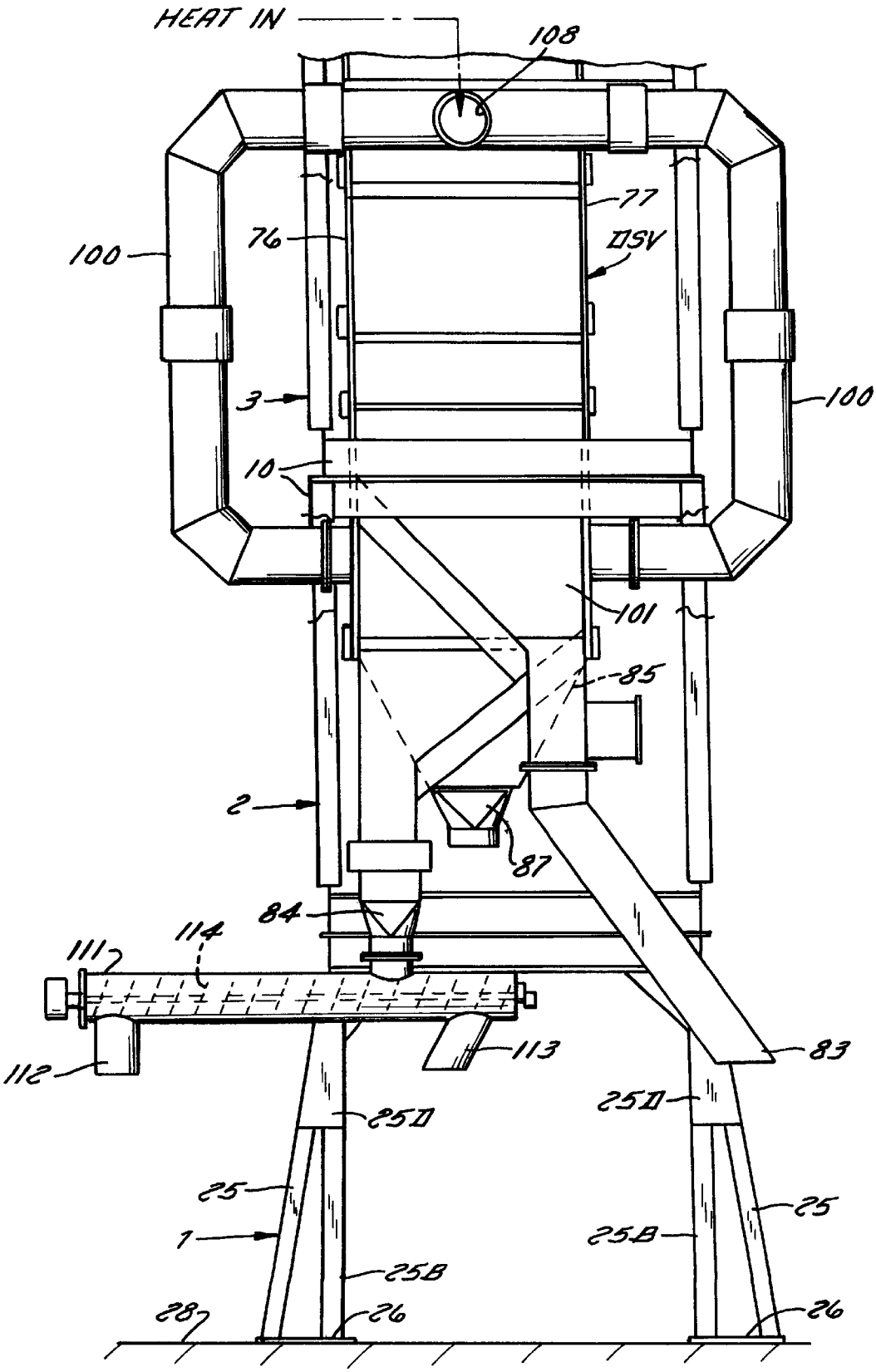
FIG. 2 is a left side elevational view of the tower shown in FIG. 1, the view being fragmentary and enlarged from that of FIG. 1, certain parts being removed for the sake of clarity.

As shown in FIG. 2, the product CM delivered from the double screen vibrator discharge chute 84 is connected to a reversible screw conveyor 111 having outlets 112 and 113 whereby the power operated reversible auger 114 in the conveyor 111 can deliver product either to the outlet 112 or 113.

Figure 12:
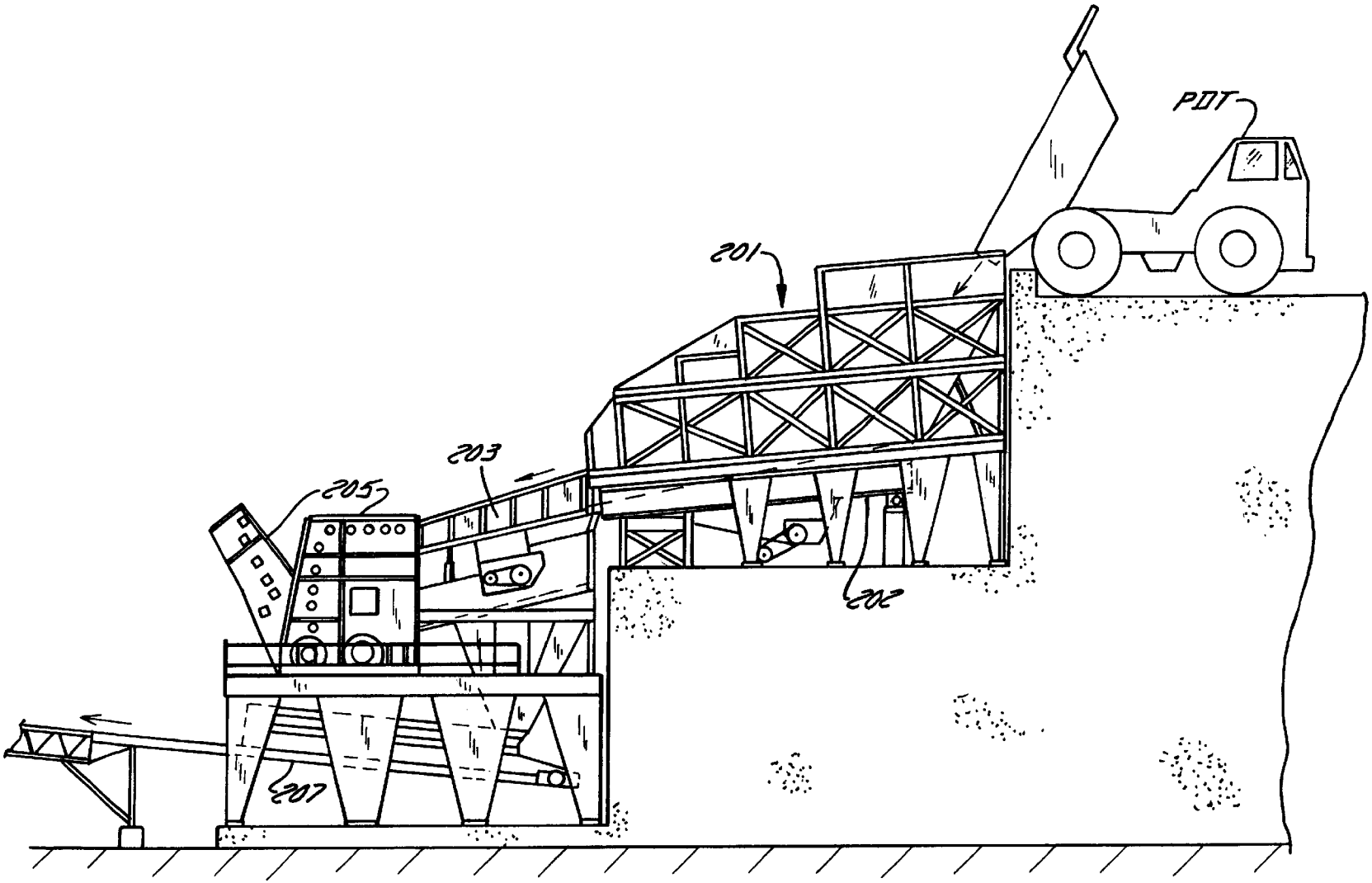
FIG. 12 is a side elevational view of a modified form of the invention.
Figure 13:
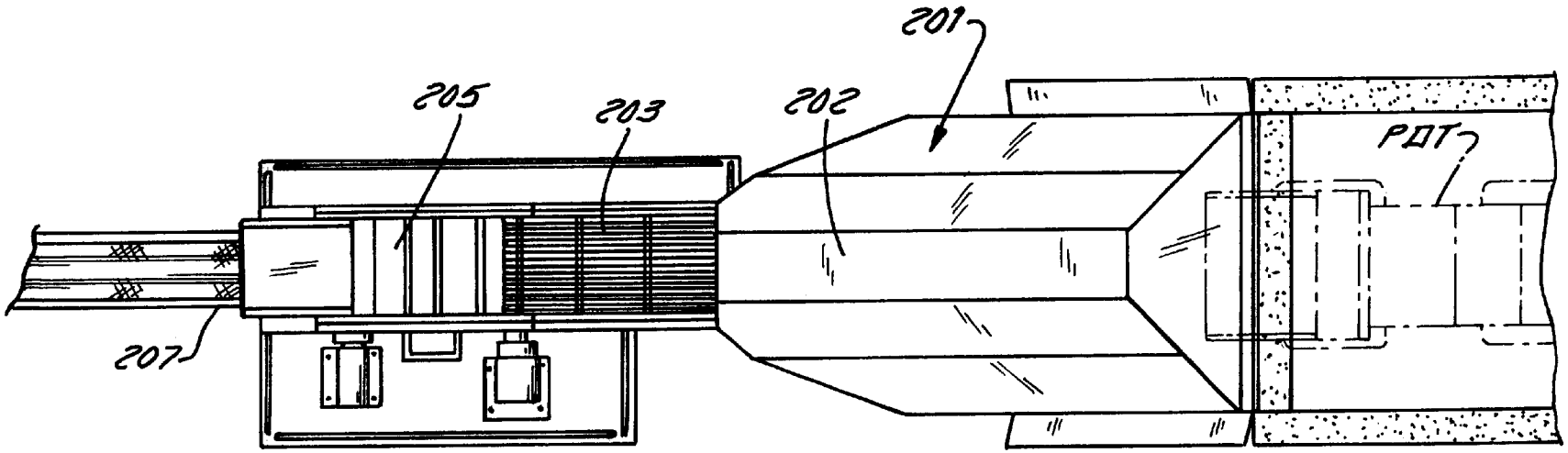
FIG. 13 is a plan view of the arrangement shown in FIG. 12.

A different arrangement of preassembled modules is shown in FIGS. 12 and 13 in which two preassembled modules are shown on the left side of the figure in stacked relationship and two other preassembled modules are shown to the right and above the other mentioned modules. The top module 201 has a 150-ton tapered feed hopper 202 with side extensions. This module receives the aggregate from the portable dump truck PDT shown. The aggregate from this hopper 201 is then fed by gravity into the lower vibrating feeder 202 having a 150 horse power electric vibrator. The material is then discharged from the vibrating feeder 202 into the adjacent single deck vibrating screen 203. This vibrator screen 203 then feeds the material into a single rotor primary impactor 205 having dual 500 horsepower electric motors. The material is fed from the impactor to the conveyor 207 located directly beneath it where it is conveyed to a subsequent station (not shown).

RECAPITULATION

The various weldment modules of the present invention are each very large and heavy and together with their internal components are fabricated in and assembled in the factory. These assembled individual modules are then transported to the field work site which may be a rock quarry and which may be located at extreme distances (perhaps in foreign countries) from the point of manufacture of the modules.

After transport to the field worksite, the modules are arranged in working relationship to one another into a stationary, fixed plant. External walkways and platforms can then be attached to the structure.

With the present invention there is provided a particularly large and stationary structure in which the individual weldment modules are preassembled at the factory and with aggregate processing equipment operatively secured within them. After transporting the individual modules to the work site, they are then arranged in working relationship to one another so that the aggregate can move through the modules and their processing equipment.

The invention provides a double screen vibrator and an air heater for drying the sand and thereby being able to make concrete sand without the use of water to wash the fine 200-mesh dust off of the coarser material. Hot air pulled through the lower screen deck dries the material sufficiently to suck off the minus 200-mesh material to thereby produce clean, dry product without the use of water.

What is claimed is:

1. A method of manufacturing a large stationary, aggregate processing screening tower and comprising, fabricating weldment modules and preassembling them with aggregate processing equipment internal within the weldment modules, transporting said weldment modules in a preassembled condition to a field work site where the tower is to be erected on a foundation, aligning said weldment modules and stacking said modules in layers and then bolting adjacent modules together, said weldment modules in a stacked-up configuration adapted to receive aggregate at the top uppermost module and permit said aggregate to be processed by screening, blending, and sizing into aggregate product as it moves downwardly by gravity through said weldment modules and their said aggregate processing equipment for final collection of said product at various levels.

2. The method set forth in claim 1 including, providing a triple deck screen in said uppermost weldment module and inclined downwardly therein for passing aggregate product downwardly over said screen, providing product collecting chutes beneath said triple deck screen for directing products out of said chutes as four different products.

3. A method of manufacturing and assembling a large stationary, aggregate processing screening tower comprising five layers of welded modules including a top module, said method comprising, fabricating said welded modules and preassembling them with aggregate processing equipment internal within the module, transporting said weldment modules in a preassembled condition to a field site where they are stacked up on one another and secured together to form said five layers of welded modules, said layers of welded modules adapted to receive aggregate product at the top module and said product is processed by screening, blending, and sizing as it moves downwardly through said welded modules and their said aggregate processing equipment for final collection of said product at various levels.

4. The method set forth in claim 3 including providing a triple deck screen in said top layer welded module and inclining it downwardly therein for passing product downwardly over said triple deck screen, providing product collecting chutes beneath said triple deck screen for directing and separating the product into different product classifications.

5. The method as described in claim 3 further characterized in that the first three layers as measured from the bottom of welded modules are assembled in stacked relationship and then a double screen vibrator is inserted downwardly into the second and third layer of said first three layers of welded modules and secured therein, and then the fourth and fifth layers from the bottom of said five layers of weldment modules are assembled thereon.

6. A large stationary, aggregate processing screening tower comprising, weldment modules preassembled with aggregate processing equipment internal within the weldment modules, said weldment modules in a preassembled condition are stacked up on one another and secured together, said weldment modules in a stacked-up configuration adapted to receive aggregate product at the top weldment module and said product is processed by screening and sizing as it moves downwardly by gravity through said weldment modules and their said aggregate processing equipment for final sizing and collection of said product.

7. A large stationary, aggregate processing screening tower comprising five layers of welded modules including a top module and having second and third lowermost layers and having aggregate processing equipment therein, said layers of welded modules secured together and adapted to receive aggregate product at said top welded module and adapted to permit said product to be processed by screening, sizing and classifying said aggregate as it moves by gravity downwardly through said layers of welded modules and their said aggregate processing equipment for final collection of said product.

8. The tower defined in claim 7 including a double screen vibrator located in the second and third lowermost layers, said vibrator having two screens positioned one above the other and mounted at a downwardly inclined angle and having a lower discharge end having outlet conduits for discharging screened product separately from each of said screens, a hot air heat conduit mounted in said second and third lowermost layers and in communication with said vibrator adjacent the discharge end of the lower of said screens and for directing hot air into said vibrator where said hot air rises within said vibrator to dry the product therein, and a gas heater in said third lowermost layer and in communication with said heat conduit for supplying hot air at about 150° F. to said conduit and then to said vibrator.

9. The tower of claim 8 further characterized in that said conduit is shaped generally circular ring-shaped and vertically positioned in said second and third lowermost layers and said ring shaped conduit has its lower portion in communication with the discharge end of said lower screen of said vibrator and said ring-shaped conduit also has an upper portion in heat receiving communication with said gas heater.

10. The tower set forth in claim 8 wherein said vibrator includes a reversible screw conveyor located below said outlet conduits for receiving product from said outlet conduits, said reversible screw conveyor conveying product selectively to two separate receptacles.

11. In a large, stationary aggregate processing screening tower, having five layers of modules, a double screen vibrator mounted in and extending through two of said layers, said double screen vibrator having two screens positioned one above the other and mounted at a downwardly inclined angle and having a lower discharge end having outlet conduits for discharging screened product separately from each of said screens, a hot air heat conduit in communication with said double screen vibrator adjacent the discharge end of the lower of said screens and for directing hot air into said vibrator where it rises within said vibrator to dry the screened product therein, and a heater in communication with said heat conduit for supplying hot air to said heat conduit and over said screened product.

12. The tower set forth in claim 11 wherein said heater is an oil burner having an output as high as 1.3 million BTU an hour maximum which can bring the moisture content of the screened product from 10–14% down to 2–3%.

13. A method of manufacturing a large stationary, aggregate processing plant and comprising, fabricating weldment modules and preassembling said modules with aggregate processing equipment internal within the weldment modules, transporting said weldment modules in a preassembled condition to a field work site where the plant is to be erected on a foundation, aligning said weldment modules with one another, said weldment modules adapted to receive aggregate at the top uppermost weldment module and permit said aggregate to be processed by feeder screens and sizing into aggregate product as said product moves by gravity through said weldment modules and their said aggregate processing equipment for final collection of said product.

14. A large stationary, aggregate processing plant comprising, weldment modules preassembled with aggregate processing equipment internal within the weldment modules, said weldment modules are arranged in aggregate processing relationship to one another, said arranged weldment modules including a top weldment module and adapted to receive aggregate product at said top weldment module processing by screening and sizing as said product moves downwardly by gravity through said weldment modules and their said aggregate processing equipment.

15. A large, stationary aggregate processing screening tower, having five layers of modules, a double screen vibrator mounted in and extending through two of said layers, said double screen vibrator having two screens positioned one above the other and mounted at a downwardly inclined angle and having a lower discharge end having outlet conduits for discharging screened product separately from each of said screens, high frequency electric vibrators connected with said screens for vibrating said screens at a frequency of 3000 to 5000 rpm, a hot air heat conduit in communication with said double screen vibrator adjacent the discharge end of the lower of said screens and for directing hot air into said vibrator where the air rises within said double screen vibrator to dry the screened product to thereby result in fine sand therein, and a heater in communication with said heat conduit for supplying hot air to said conduit and over said fine sand to reduce the moisture content of the fine sand to 2% to 3% and remove the fine 200-mesh particles of sand to achieve production of concrete sand in a dry application.

* * * * *